United States Patent [19]

Jensen

[11] 4,234,294

[45] Nov. 18, 1980

[54] DEEP WELL HYDRAULIC PUMP SYSTEM USING HIGH PRESSURE ACCUMULATOR

[76] Inventor: James B. Jensen, Rte. 2, Coffeyville, Kans. 67337

[21] Appl. No.: 11,400

[22] Filed: Feb. 12, 1979

[51] Int. Cl.[3] ..... F04B 9/10

[52] U.S. Cl. ..... 417/377; 417/390; 417/403

[58] Field of Search ..... 417/377, 390, 392, 401, 417/403, 383, 385

[56] References Cited

U.S. PATENT DOCUMENTS

| | | | |
|---|---|---|---|
| 2,628,565 | 2/1953 | Richardson | 417/377 |
| 2,708,411 | 5/1955 | Richardson | 417/377 |
| 3,159,105 | 12/1964 | Chenault | 417/401 X |

*Primary Examiner*—Richard E. Gluck
*Attorney, Agent, or Firm*—Head & Johnson

[57] ABSTRACT

A deep well hydraulic pump system using a high pressure accumulator, comprises a down hole pump which is lowered on tubing into the borehole and has a large cylinder and piston connected to a small cylinder and piston with a common piston rod. The large cylinder is connected to the surface by a liquid pipe inside of the tubing. A surface motor-driven pump in one part of the pumping cycle takes liquid from which a high pressure accumulates and pumps it at high pressure through the liquid pipe into the large cylinder, forcing the piston down, and forcing well liquid up the tubing. Part of this liquid goes to a sump and part goes through a pressure sensitive valve to storage. In the second part of the cycle the surface pump draws from the sump and pumps liquid down the tubing. This raises the piston in the large cylinder and lifts liquid through the foot valve into the small cylinder, ready for the next repetition of the two-part cycle. The liquid pumped from the large cylinder flows into the high pressure accumulator.

4 Claims, 3 Drawing Figures

DEEP WELL HYDRAULIC PUMP SYSTEM USING HIGH PRESSURE ACCUMULATOR

BACKGROUND OF THE INVENTION

1. Field of the Invention

This invention lies in the field of apparatus for pumping liquids from deep boreholes, such as deep water or oil wells. More particularly, it concerns a type of deep well pump in which a continuously driven hydraulic pump at the surface provides motive power to drive a down hole reciprocating pump in which one cylinder and piston provides the force to drive a second piston in a smaller cylinder to pump liquid up the tubing.

Still more particularly this invention relates to a method by which a high pressure accumulator acts as a storage of energy during the second part of the pumping cycle in which liquid is not lifted from the borehole, and the accumulator applies its stored energy to aid the surface pump in the first part of the pumping cycle in which liquid is lifted from the borehole.

2. Description of the Prior Art

In the prior art there are instances where hydraulic pumps have been placed in a deep borehole, hung on tubing, in which a hydraulic pump at the surface supplied pressurized liquid to the down hole pump in order to pump well liquids up the tubing. Unlike the situation in the case where sucker rod pumps are used with surface mechanical pumping equipment in which a mechanical counterbalance can be utilized to average out the irregular pumping force required in the two-part pumping cycle, in which the sucker rods are lowered and then lifted, carrying the pumped liquid, the hydraulic systems in the prior art have not utilized a counterbalance equivalent. This causes a highly variable pumping force requirement and necessitates a larger size of engine to drive the system. The counterbalance in this instance is provided with a high pressure hydraulic accumulator which accepts and stores energy during the part of the pumping cycle in which little energy is required from the surface pump, and on the next part of the cycle, delivers the stored energy to assist the surface pump.

SUMMARY OF THE INVENTION

It is a primary object of this invention to provide a down-hole, deep-well hydraulic pump system in which a high pressure hydraulic accumulator is utilized to store hydraulic energy in those portions of the pumping cycle in which high energy is required to lift liquids from the deep well.

These and other objects are realized and the limitations of the prior art are overcome in this invention by providing a down-hole hydraulic pump, which includes two pistons and cylinders. One cylinder is larger than the other. The large piston drives the piston in the small cylinder, which serves as the pump for lifting liquids from the bottom of the well up into the tubing. The hydraulic power required to drive the down-hole large cylinder is supplied by a motor-driven pump at the surface.

The pumping system includes a first pipe connected from the surface, down inside of the tubing, to the large cylinder. A second pipe connects from the top of the tubing to a first end of a third cylinder, in which there is a free traveling third piston. A third pipe extends from the other end of the third cylinder. The second pipe also connects to a first pressure sensitive valve, such that when the pressure is high, it will open and exhaust liquid from the second pipe to storage.

A motor-driven pump of any selected type can be used to pump liquid on the first half cycle from an accumulator through the first pipe, down to the large cylinder. The movement of the piston of the large cylinder downward drives liquid from the pump into and up the tubing, and through the second pipe, driving the third piston in the third cylinder and exhausting liquid from other side of the third piston to a sump. On the next half-cycle, the pump by means of a valve system takes liquid from the sump and pumps it down through the third pipe into the third cylinder, driving the piston to exhaust liquid through the second pipe into the top of the tubing. This lifts the piston in the large diameter cylinder and also carries with it the piston of the small cylinder, which lifts a selected volume of well liquid from the bottom of the borehole, through the standing valve, and up into the tubing.

Because the load on the surface pump is greatest during the first half of the pumping cycle, the high pressure accumulator provides pressurized liquid which assists in the pumping so that the load on the surface pump is reduced on the first half-cycle, although it increases the load on the surface pump during the second half-cycle. Thus, the high pressure accumulator acts as a temporary storage of energy which accepts energy in the form of pressurized liquid from the surface pump during the second half-cycle and delivers energy to the pump on the first or lifting half of the cycle.

When the piston of the large cylinder in the subsurface pump is moved downwardly, fluid is locked in the small cylinder by the foot valve, and therefore fluid is displaced from the subsurface pump into the tubing and lifts the column of liquid in the tubing to flow through the second pipe and through the third cylinder, moving the piston to discharge liquid into the third pipe and through the third pipe and the valve system to the sump. On the second half of the pumping cycle, the valve system is changed so that the surface pump draws liquid from the sump and flows through the third cylinder and the second pipe, into the top of the tubing, forcing liquid downward inside the tubing, to lift the piston of the large cylinder. This drives liquid from the large cylinder through the first pipe, and through the valve system to the high pressure accumulator. Since the lifting load on the surface pump is absent, a major part of the surface pump output goes to store liquid under pressure in the accumulator. On the next half of the pumping cycle this pressurized liquid will assist the surface pump.

The switching of the valve system handles the substitution from one source of liquid to the pump, to the others, that is, from the sump to the accumulator, and vice versa. The valve system also switches the output of the pump from the first pipe to the top of the tubing through the second pipe. This is done by a valving system in which the shifting of the valves is done by hydraulic pressure, which results from the actual flow of pumping or control liquid. For example, when the liquid is flowing from the surface pump through the first pipe to the large cylinder, and when the piston of the large cylinder reaches its end position and stops, the liquid pressure in the first pipe will rise. There is a second pressure sensitive valve connected to the first pipe so that when the pressure rises above a selected value, liquid will flow from the first pipe through the second pressure sensitive valve to switch the valve system and throw it from a first position to a second position. Conversely, when the pump is delivering liquid to the top of the tubing, the control liquid passes into the third cylinder. When the third piston reaches the end of its travel, again the pressure of the liquid in the third pipe rises and passes through a third pressure sensitive valve to switch the main valve system back into its first position. Thus, dependent on the volume of flow, the valve system is automatically switched from a first to a second position and then back to the first position, in order to control the flow of pump driven control liquid to operate the down hole pump system.

BRIEF DESCRIPTION OF THE DRAWINGS

These and other objects and advantages of this invention and a better understanding of the principles and details of the invention will be evident from the following description taken in conjunction with the appended drawings in which.

DESCRIPTION OF THE PREFERRED EMBODIMENTS

Figure 1:
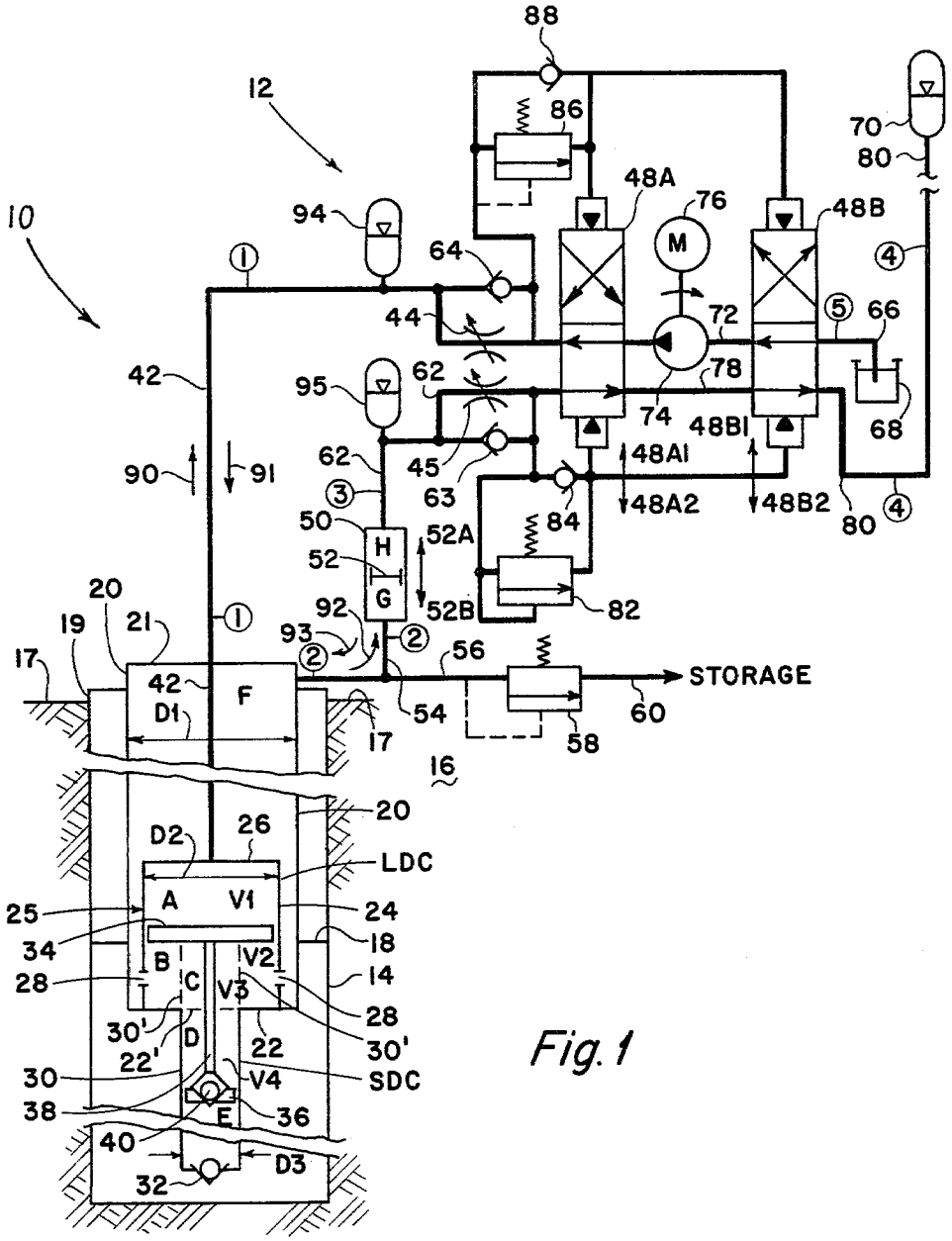
FIG. 1 is a schematic diagram of the complete deep borehole hydraulic pump system.

Referring now to the drawings and in particular to FIG. 1, a schematic diagram shows the complete operating system, including the down-hole pump, which is indicated generally by the numeral 10. The surface equipment is generally indicated by the numeral 12. There is a deep borehole, or well 14, drilled in the earth 16, which extends downward from the surface 17 to a selected depth, for example, to an oil producing formation from which oil is driven into the borehole by contained gas pressure. The well liquid will accumulate in the bottom of the borehole to the depth indicated by a surface 18. Such boreholes are also well-known as wells, and the terms borehole and well will be used interchangeably.

The down-hole pump is indicated generally by the numeral 25 and includes a large diameter cylinder (LDC) 24 which is closed at the top 26. The large diameter cylinder 24 which has a diameter D2 is connected by means of the closure 22 at its bottom to a small diameter cylinder (SDC) 30 that has an inner diameter D3. There is a piston 34 inside of the large diameter cylinder 24 and a small piston 36 inside of the small diameter cylinder (SDC) 30.

The two pistons are connected by a connecting rod 38 of selected length. There is a check valve, called a traveling valve 40, mounted in the small piston 36. There are a plurality of openings 28 in the lower portion of the large diameter cylinder below the lowermost position of the large piston 34. These openings permit liquid to flow from the inside of the large diameter cylinder below the piston and from the small diameter cylinder above the piston through the openings 28 and into the interior of the tubing 20 which hangs from the surface casing 19 and supports the pump 25 at its lower end. For convenience, the space inside of the LDC is indicated as space A and has a maximum volume V1. In the space below the piston 34 to the bottom 22 of the LDC, the volume is broken up into two parts, a small axial volume C of volume V3, which has a diameter equal to D3. There is an annular volume indicated as B of volume V2 comprising the space between the dashed cylinder 30' and the other diameter D2. Also the space between the bottom 22 of the LDC and the piston 36 is indicated as space D of volume V4. The space below the piston 36 to the foot valve 32 is indicated as space E of volume V5. The space within the tubing 20 up to the top closure 21 is indicated for convenience as space F.

A first pipe 42 is also indicated by the numeral 1 in a circle and reaches from the surface through the top 21 of the tubing 20 down inside of the tubing and into and through the top 26 of the LDC. Thus, control or pump liquid, such as oil, can be delivered into, and withdrawn from, the space A through the first pipe 42.

There is a third cylinder 50 which has a free traveling piston 52. A first end of the third cylinder 50 is connected by a second pipe 54 indicated by the numeral 2 in a circle, which connects to the top of the tubing 20. A third pipe 62 connects to the second end of the third cylinder 50. There is a sump 68 which has a pipe 66 connected thereto which will be called a fifth pipe. There is a high pressure hydraulic accumulator 70 which is served by a pipe 80 which is identified as the fourth pipe.

There is a valve system 48, which is for convenience shown as two separate valves 48A and 48B. Each valve has a first position identified as 48A1 and 48B1 respectively, and a second position identified as 48A2 and 48B2 respectively. These two valves 48A and 48B could equally well be built into a single structure, although it is more convenient to illustrate them as separate structures. The diagram of FIG. 1 shows these valves in their upper or first positions.

The pumping cycle includes two separate operations or parts. The first part starts with the large piston 34 in its uppermost position, that is, with volume V1 a minimum, and the valves 48A and 48B in their first or upper positions, shown in the drawing. The first half of the pumping cycle provides for fluid flow driving the piston 34 downwardly and the second half of the cycle provides for driving the piston 34 upwardly.

Starting with the piston 34 in its uppermost position, a surface pump 74 driven by a motor 76 draws liquid from the sump 68 through the fifth pipe 66, through the valve 48B, through the line 72, through the pump 74, and out of the pump through the valve 48A, through a first choke 44 and through the first pipe 42 in accordance with arrow 91 down into the LDC, and into the space A. This drives the piston 34 downwardly and with it the small piston 36. As the small piston moves downwardly in the SDC 30, since the check valve 32 in the base of the SDC prevents downward flow of liquid from the space E, liquid will flow from the space E through the valve 40 into the space D.

Furthermore, because the sum of the volumes in D and E is constant due to the valve 32, liquid in the volumes B and C will be reduced and will flow out through the openings 28 around the outer wall 24 of the SDC, and up into the tubing space F, and out through the second pipe 54, through and into space G of the third cylinder 50, driving the piston 52 upwardly, and driving liquid from the space H of the third cylinder 50, through the third pipe 62, through the valve 48A, line 78, valve 48B and through the fourth pipe 80 into the accumulator 70. This liquid then remains in the high pressure accumulator under pressure as a storage of energy, utilizing some of the energy produced by the pump 74 during the first half of the pumping cycle.

On the second half of the pumping cycle, the valves 48A and 48B are moved to their second or lower positions.

In the second half of the pumping cycle, the surface pump 74 receives liquid from the accumulator 70, through the fourth pipe 80 through the valve 48B, line 72, and delivers pressurized liquid according to the cross-over of valve 48A and out through the third pipe 62 into the space H of the third cylinder driving the piston 52 downwardly, and driving liquid out of the space G, through the second pipe 54, into the top of the tubing 20. The downward flow of liquid in the tubing flows through the openings 28 into the spaces B and C, lifting the piston 34. This drives liquid from the space A, reducing the volume V1 and delivering liquid through the first pipe in accordance with arrow 90, through the cross-over of the valve 48A, into line 78, through valve 48B, and through the fifth pipe 66 into the sump 68.

In other words, the upward movement of the piston 34 comprises the lifting half-cycle of the pumping cycle. Consider the liquid that moves out through the space G into the second pipe 54. When the piston 34 reaches its uppermost position any further flow of liquid in the second pipe causes the pressure therein to rise to a high value. Because of the pressure sensitive valve 58, this pressure causes the valve 58 to open and to discharge liquid from the pipe 56 through the valve 58 and to an outlet pipe 60 to a storage tank.

On the first half of the pumping cycle the pump delivers control or pump liquid through the first pipe into the LDC, as the piston 34 moves downward and delivers liquid from the volumes B and C to be lifted through the space F into the accumulator 70. On the second half of the pumping cycle, the pump 74 delivers liquid through the third pipe, through cylinder 50, and second pipe, into the tubing through the openings 28, lifting the piston 34. However, what is required from the pump 74 is to fill the space B beneath the piston 34 and the lifting of the small piston 36 which delivers liquid from the well to fill the space C, part of it going out through the line 60 to storage.

Means are provided for automatically switching the valves 48A and 48B from their position 1 to their position 2 and back, and so on. This is done by means of small pistons built into the valves, one on each end that can move the spool from one end of its travel to the other. The hydraulic control of the valves is by means of pressure sensitive valves 86 and 82.

The first pipe has a control choke 44 built in for purposes of controlling the flow from the pump 74 into the first pipe and to the LDC. Similarly, a second choke 45 is provided in the third pipe to control the flow in the reverse direction to operate the LDC. These chokes are bypassed by check valves 63 and 64 respectively so that on the return flow from pipe 1, for example, in the direction of arrow 90, the flow would be through the check valve 64 instead of through the choke, and similarly, when the flow in the second pipe is in the direction 92, the flow goes through the check valve 63 to minimize any resistance as it flows either to the sump 68 or to the accumulator 70.

There is a pressure sensitive valve 86 which, when the pressure in the first pipe rises (and this will occur when the liquid has flowed through the first pipe in the direction 91 and the piston 34 has reached its bottom position and cannot move farther), will open and momentarily apply pressure to the control pistons of the valves 48A and 48B to move them from their first positions 48A1 and 48B1 to their second positions 48A2 and 48B2. Similarly, there is a valve 82 connected to the third pipe and when liquid flows from the pump 74 into the third pipe and into the space H, as the piston 52 moves to its bottommost position and cannot move further, the pressure will rise and cause the valve 82 to open momentarily and to apply pressure to the pistons in the bottom ends of the valves 48A and 48B. This will move the valves into their first position.

If desired, low pressure accumulators 94 and 95 can be placed in the first pipe and third pipe respectively to minimize the range of pressures and eliminate pressure surges in those pipes, as is well known in the art.

Figure 2A:
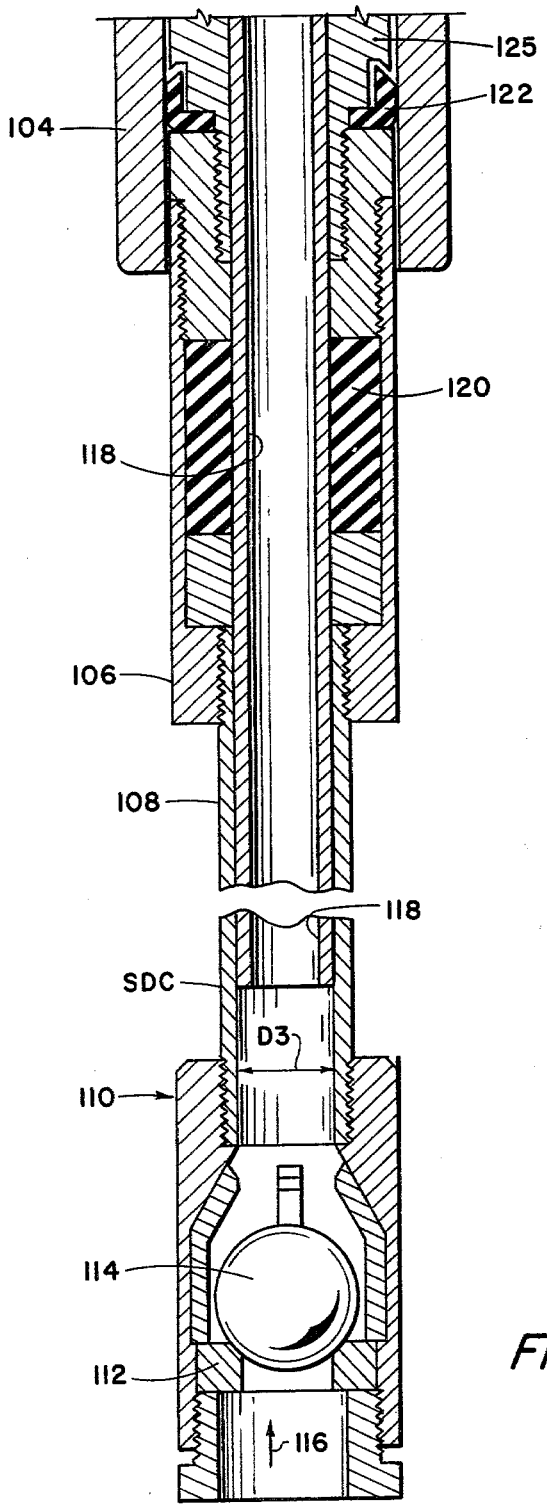
FIGS. 2A and 2B together show a preferred embodiment of a down hole pump which can be used in the system of FIG. 1.
Figure 2B:
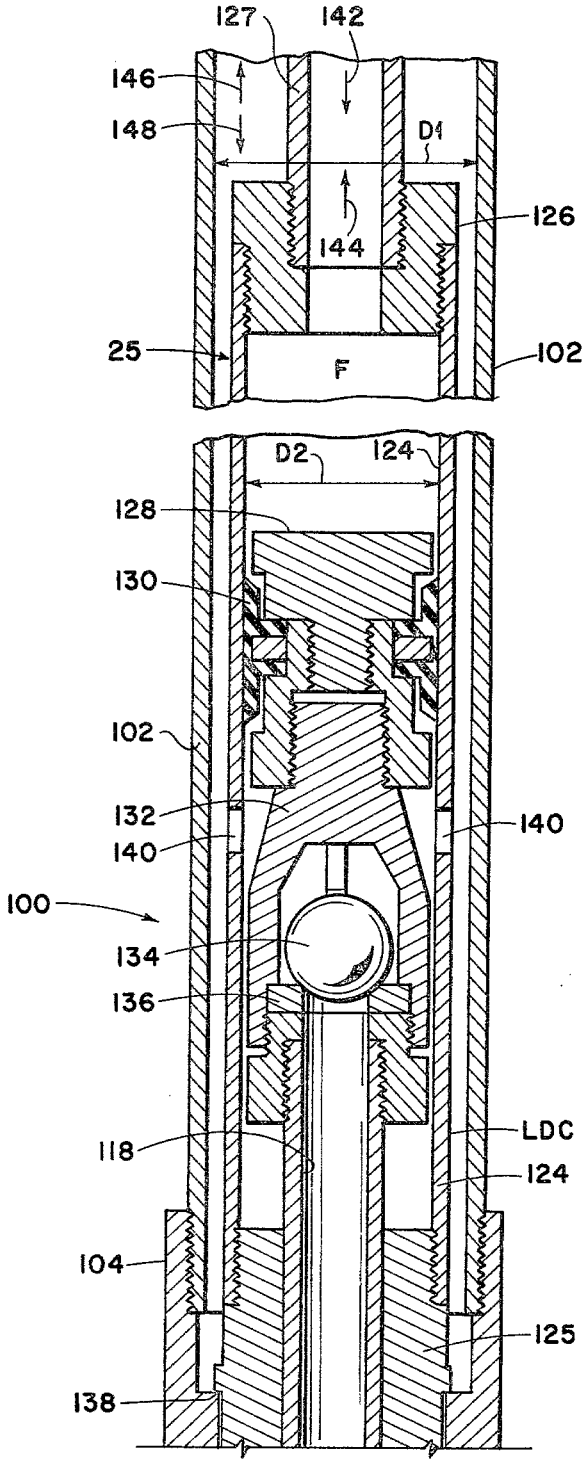

Referring now to FIGS. 2A and 2B, these are individually two parts of the down-hole pump 25 of FIG. 1, also identified by that number in FIG. 2B. The tubing 102 extends from the surface down to a seating nipple 104 at its bottom end. The bottom hole pump indicated generally by the numeral 25 comprises a large diameter cylinder 124 which has a cap 126 into which is fastened a small diameter pipe 127 identified as pipe No. 1. This small pipe serves to lower the pump 25 down inside of the tubing. The diameter of the pump is less than the inner diameter D1 of the tubing in order to permit flow of well liquids in the annulus between the pump and the tubing. The large diameter cylinder has ports 140 which are below the lowermost position of the piston 128 which has appropriate seal rings 130 to seal against the inner wall of the cylinder 124 as the pump piston moves upwardly and downwardly. A short piston rod 132 connects piston 128 of the LDC to the piston 118 of the SDC. The piston 118 happens to be tubular, instead of solid so that well liquids can move upwardly inside of the piston 118 and past the check valve, which comprises the ball 134 inside of the cage, which is part of the piston rod 132. The ball 134 seals against the seat 136.

The bottom end of the LDC has a seating plug 125 which has an annular circumferential ring 138 which rests upon a seating shelf or shoulder of the seating nipple 104, so that as the pump is lowered into the tubing, it will rest on that shoulder. Seal means 122 are provided by a plug in the bottom of the seating nipple, so that as the pump is seated it is automatically sealed against liquid flow around the outside of the plug 125.

Supported in the bottom end of the seating nipple is a packing structure 106 which includes packing 120 which seals against the outer surface of the piston 118 of the SDC. The packing structure also supports a tube 108 which is the SDC and which carries at its bottom end a foot valve, which comprises a ball 114 seated in a seal ring 112, to permit flow of liquid in the direction of the arrow 116. The piston 118 slides in the SDC 108 and is sealed by the seal packing 120.

Comparing FIGS. 2A and 2B taken together as a single structure with FIG. 1, it will be clear that all of the features of the down-hole pump 25 are present in the structure indicated generally by the numeral 100, which operates in an identical manner to the schematic pump of FIG. 1.

What has been described is a hydraulic pumping system which will lift liquids from deep wells. The system uses a motor-driven pump at the surface to provide pressurized liquid to drive a reciprocating pump lowered into the bottom of the tubing, the power cylinder or LDC receives pressurized liquid from the surface to move downwardly on the lifting half of the cycle, which depresses liquid from the bottom of the piston into the tubing, up the tubing, and into the sump and to storage and on the reverse half of the cycle, the pump at the surface provides pressurized liquid to move into the top of the tubing down through the tubing and up under the piston of the LDC, flowing liquid out of the LDC into a high pressure accumulator at the surface. The high pressure accumulator will store hydraulic energy until the next half-cycle when it releases this energy to aid the surface pump in the lifting process.

No further description is provided of the motor-driven pump, hydraulic accumulator sump, valve system, etc. since all of these items are conventional products sold over the counter and well known in the art.

The pump liquid or control liquid can be any desired liquid, but is preferably an oil such as used in hydraulic systems. This liquid is completely sealed and separated from the well liquid by the piston packing in the LDC and the piston seal in the third cylinder.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An hydraulic pump system for pumping liquids from deep wells, comprising:

(a) a down hole pump attached to the bottom end of a tubing string of inner diameter D1, hung from the surface and immersed in well liquid, comprising;

(1) a large diameter cylinder (LDC) closed at the top and open at the bottom and of diameter D2 less than D1;

(2) a small diameter cylinder (SDC) open at the top of diameter D3 less than D2, with a foot check valve in the bottom of said SDC; said LDC and SDC connected together at their open ends;

(3) a large piston in said LDC is connected to a small piston in said SDC by means of a common piston rod, and there is a traveling check valve in said small piston;

(4) the bottom end of said LDC and the top end of said SDC communicating with the tubing, whereby liquid lifted by said small piston can flow into and up said tubing;

(b) first pipe means extending from the surface inside said tubing through the closed end of said LDC:

(c) said tubing closed at the surface of the earth and second pipe means connected between the top of said tubing and a first end of a third cylinder enclosing a free traveling piston;

(d) third pipe means connected into the second end of said third cylinder;

(e) high pressure accumulator means, and fourth pipe means connected to said high pressure accumulator means;

(f) sump means and fifth pipe means connected to said sump means;

(g) continuous motor-driven liquid pump (MDLP) means;

(h) valve means adapted to move back and forth between a first position and a second position and wherein;

(1) when said valve means is in said first position, said (MDLP) is connected at its input to said fifth pipe means, and on its output to said first pipe means, and said third pipe means is connected to said fourth pipe means; and (2) when said valve means is in said second position, said (MDLP) is connected at its input to said fourth pipe means, and on its output to said third pipe means; and said first pipe means is connected to said fifth pipe means;

(i) first pressure sensitive valve means connected to said second pipe means; and (j) means responsive to the volume flow of liquid to move said valve means between said first and second positions.

2. The hydraulic pump system as in claim 1 including a first adjustable choke means in said first pipe means, and a second adjustable choke means in said third pipe means, and a check valve shunting each of said choke means.

3. The hydraulic pump system as in claim 2, including second pressure sensitive valve means connected to the pump side of said first choke means to switch said valve means from said first position to said second position; and a third pressure sensitive valve means connected to the pump side of said second choke means, to switch said valve means from said second position to said first position.

4. The hydraulic pump system as in claim 3 including low pressure accumulator means connected one each to said first pipe and said third pipe.

* * * * *